US010783825B2

(12) United States Patent
Liu et al.

(10) Patent No.: US 10,783,825 B2
(45) Date of Patent: Sep. 22, 2020

(54) DRIVING SUBSTRATES AND DISPLAY PANELS

(71) Applicant: Kunshan Go-Visionox Opto-Electronics Co., Ltd., Kunshan (CN)

(72) Inventors: Quan Liu, Kunshan (CN); Xu Qin, Kunshan (CN); Lu Zhang, Kunshan (CN); Siming Hu, Kunshan (CN); Zhenzhen Han, Kunshan (CN)

( * ) Notice: Subject to any disclaimer, the term of this patent is extended or adjusted under 35 U.S.C. 154(b) by 0 days.

(21) Appl. No.: 16/441,033

(22) Filed: Jun. 14, 2019

(65) Prior Publication Data

US 2019/0304359 A1 Oct. 3, 2019

Related U.S. Application Data

(63) Continuation of application No. PCT/CN2018/111716, filed on Oct. 24, 2018.

(30) Foreign Application Priority Data

May 14, 2018 (CN) ..... 2018 1 0457671

(51) Int. Cl.
*G09G 3/3225* (2016.01)
*G09G 3/20* (2006.01)

(52) U.S. Cl.
CPC ..... *G09G 3/3225* (2013.01); *G09G 3/2085* (2013.01)

(58) Field of Classification Search
CPC .... G09G 3/3225; G09G 3/2085; H01L 27/32; H01L 27/3276; H01L 51/52; H01L 51/56
See application file for complete search history.

(56) References Cited

U.S. PATENT DOCUMENTS

| | | | | |
|---|---|---|---|---|
| 10,304,913 | B2 * | 5/2019 | Choi | H01L 27/3276 |
| 10,354,578 | B2 * | 7/2019 | Ka | H01L 27/3223 |
| 10,418,434 | B2 * | 9/2019 | Kim | H01L 27/3262 |
| 10,461,070 | B2 * | 10/2019 | Kim | H01L 51/5256 |
| 2017/0012063 | A1 | 1/2017 | Kwak | |

(Continued)

FOREIGN PATENT DOCUMENTS

| | | | |
|---|---|---|---|
| CN | 105097842 | A | 11/2015 |
| CN | 105789251 | A | 7/2016 |

(Continued)

OTHER PUBLICATIONS

CN First Office Action dated May 22, 2019 in the corresponding on application (application No. 201810457671.9).

*Primary Examiner* — Sardis F Azongha
(74) *Attorney, Agent, or Firm* — Kilpatrick Townsend & Stockton

(57) ABSTRACT

Disclosed are a driving substrate and a display panel. The driving substrate includes a substrate defining an irregular-shape non-display area, an anode layer, located on the irregular-shape non-display area and provided with a first curved groove for encapsulating, and an organic unit array formed on a surface of the anode layer away from the substrate. The organic unit array includes a number of organic units forming a number of unit rows and unit columns. The distances between every two adjacent organic units in each unit row or in each unit column are identical. The first curved groove is located between two organic units.

17 Claims, 2 Drawing Sheets

(56) References Cited

U.S. PATENT DOCUMENTS

| | | | | |
|---|---|---|---|---|
| 2017/0110532 | A1* | 4/2017 | Kim | H01L 51/5246 |
| 2017/0221762 | A1 | 8/2017 | Cai et al. | |
| 2017/0288004 | A1* | 10/2017 | Kim | H01L 27/3276 |
| 2019/0280060 | A1* | 9/2019 | Liu | H01L 51/5256 |
| 2019/0312226 | A1* | 10/2019 | Huang | H01L 51/56 |

FOREIGN PATENT DOCUMENTS

| | | | |
|---|---|---|---|
| CN | 106653818 | A | 5/2017 |
| CN | 107393907 | A | 11/2017 |
| CN | 107689425 | A | 2/2018 |
| CN | 108010949 | A | 5/2018 |
| CN | 108666442 | A | 10/2018 |
| WO | 2019041864 | A1 | 3/2019 |

* cited by examiner

DRIVING SUBSTRATES AND DISPLAY PANELS

CROSS REFERENCE TO RELATED APPLICATIONS

This application is a continuation application of International Application PCT/CN2018/111716, filed on Oct. 24, 2018, which claims priority of Chinese Patent Application No. 201810457671.9, filed on May 14, 2018, entitled "DRIVING SUBSTRATE AND DISPLAY PANEL", and the entire contents of the both applications are incorporated herein in their entirety.

BACKGROUND

As the development of mobile phones, screens of full screen mobile phones are broadly concerned due to advantages of having a larger screen ratio and a narrower bezel, which can improve visual effects for observer considerably. During a process of manufacturing a screen of the full screen mobile phone, an irregular-shape display area is generally formed on the screen with an irregular-shape design such as notching and the like. An edge of the irregular-shape display area is generally in an irregular structure such as a curved structure or the like.

SUMMARY

In view of above, it is needed to provide driving substrates and display panels in regard with the problem that bonding between a cathode and an anode of an irregular-shape non-display area of a driving substrate is uneven.

Provided is a driving substrate, including:

a substrate, comprising an irregular-shape non-display area;

an anode layer, located on the irregular-shape non-display area and provided with a first curved groove for encapsulating; and an organic unit array, comprising a plurality of organic units, and disposed on a surface of the anode layer away from the substrate, the plurality of organic units forming a plurality of unit rows and a plurality of unit columns, distances between every two adjacent organic units in each unit row being identical, distances between every two adjacent organic units in each column row being identical, and the first curved groove being located between two organic units of the organic unit array.

In an embodiment, a symmetric center line of the first curved groove is a curved line, and is parallel to an edge of the irregular-shape non-display area.

In an embodiment, the anode layer is provided with an opening, and the organic unit is formed on an upper surface of the anode layer by deposition, and covers the opening on the anode layer.

In an embodiment, the organic unit is a central symmetric structure.

In an embodiment, the organic unit is a square structure.

In an embodiment, the square structure has a side length of 15 μm to 20 μm.

In an embodiment, the first curved groove has a width of 3 μm to 7 μm, and the distance between any two adjacent organic units is 10 μm to 22 μm.

In an embodiment, the first curved groove has a symmetric center line, and a distance from the symmetric center line to any one of the organic units is greater than 2 μm.

In an embodiment, the substrate and the anode layer have a circuit protection layer disposed therebetween, and the circuit protection layer is provided with a second curved groove corresponding to the first curved groove.

In an embodiment, a portion of the anode layer deposited in the second curved groove fills the second curved groove when forming the anode layer.

In an embodiment, the circuit protection layer is made of an organic material.

In an embodiment, the substrate and the circuit protection layer have a pixel drive circuit layer disposed therebetween.

In an embodiment, a cathode layer is formed on a surface of the organic unit array away from the substrate, and the cathode layer is bonded to the anode layer via a plurality of gaps defined between organic units of the plurality of organic units of the organic unit array.

In an embodiment, bonding areas of the cathode layer and the anode layer between every two adjacent organic units of the plurality of organic units are identical.

Provided is a display panel, including the driving substrate described above. An irregular-shape display area surrounded by the irregular-shape non-display area.

In an embodiment, an edge of the irregular-shape display area has a shape same as that of the first curved groove.

In an embodiment, the display panel is provided with a notch, and a portion of the non-display area surrounding the notch forms the irregular-shape non-display area.

According to the driving substrate provided by the present disclosure, since the first curved groove is located between two organic units of the organic unit array, the first curved groove is not in contact with the organic units, to avoid the organic units from falling into the first curved groove. On the basis that the organic units do not fall into the first curved groove, the distances between every two adjacent organic units in each unit row or in each unit column are identical, thus ensuring the plurality of organic units is disposed evenly in the organic unit array. The gaps between every two adjacent organic units are the same in size. Since the cathode layer is formed on the surface of the organic unit array away from the substrate, and is bonded to the anode layer via the gap between two organic units, the bonding areas of the cathode layer and the anode layer between two adjacent organic units are identical. Therefore, the problem of uneven bonding between the anode layer and the cathode layer caused by the removal of a portion of the organic units is avoided, such that the display brightness of the screen is more uniform.

DETAILED DESCRIPTION OF THE EMBODIMENTS

In conventional processes, during manufacturing of a driving substrate, since the edge of the irregular-shape display area is in an irregular structure such as a curved structure or the like, bonding between a cathode and an anode of an irregular-shape non-display area of a driving substrate is caused to be uneven, which easily causes ununiformity of luminance of the screen, affecting viewing perception.

Figure 1:
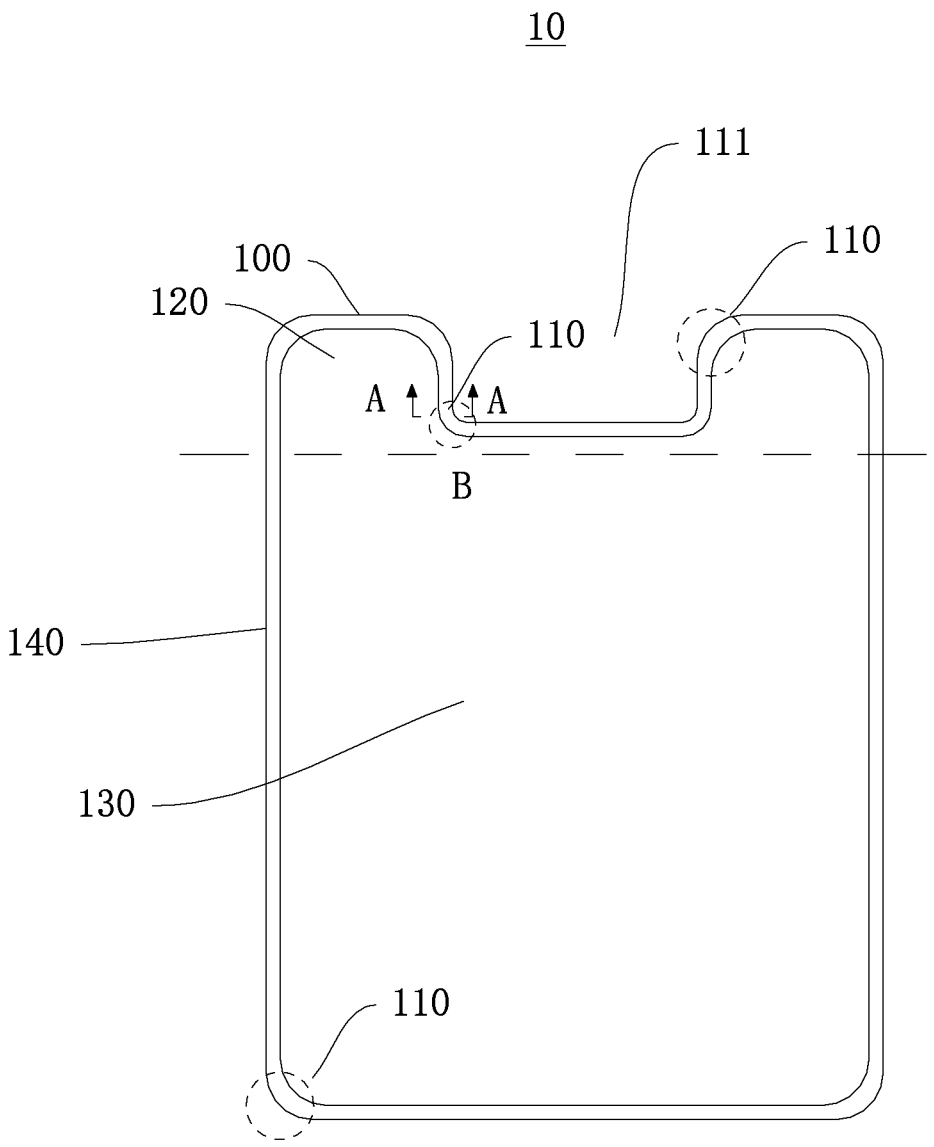
FIG. 1 is a schematic view of a driving substrate provided by an embodiment of the present disclosure.
Figure 2:
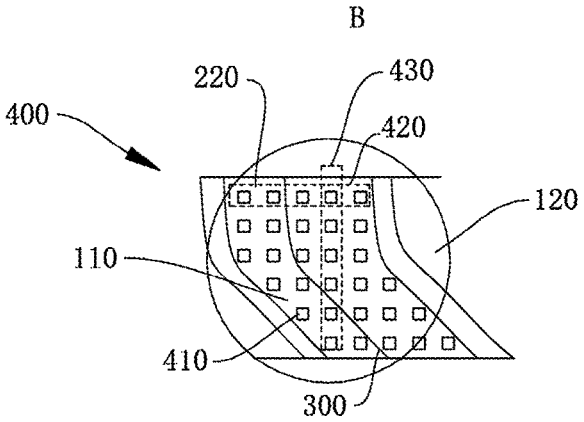
FIG. 2 is a partial enlarged view of a driving substrate provided by an embodiment of the present disclosure.

Referring to FIGS. 1-2, an embodiment of the present disclosure provides a driving substrate 10 including a substrate 100, an anode layer 200 and an organic unit array 400. The substrate 100 includes an irregular-shape non-display area 110. The anode layer 200 is formed on the irregular-shape non-display area 110. The anode layer 200 is provided with a first curved groove 300 for encapsulating. The organic unit array 400 is disposed on the anode layer 200. The organic unit array 400 includes a plurality of organic units 410 spaced apart from one another. The organic units 410 are disposed on a surface of the anode layer 200 away from the substrate 100, and the plurality of organic units 410 form a plurality of unit rows 420 and a plurality of unit columns 430. Distances between every two adjacent organic units 410 in each unit row 420 or in each unit column 430 are identical. The first curved groove 300 is located between two organic units 410 of the organic unit array 400. In the organic unit array 400, the first curved groove 300 passes between any two adjacent organic units 410.

The irregular-shape non-display area 110 may be a corner portion of the display panel. The corner portion may be of a curved shape or a non-right angular shape. The display panel may be provided with a notch 111. The notch 111 may be of a shape of a circle, an oval, a semicircle or other non-linear irregular structures. A portion of the non-display area surrounding the notch 111 forms the irregular-shape non-display area 110. The shape of the irregular-shape non-display area 110 may correspond to the shape of the notch 111. In an embodiment, when an edge of the notch 111 is a curved line, an edge of the irregular-shape non-display area 110 is also a curve that is parallel to and corresponds to the curved line.

The anode layer 200 is configured to connect the cathode layer 230. The organic unit 410 may be made of an organic material. The first curved groove 300 is configured for encapsulating. During an encapsulation process of the substrate, the first curved groove 300 can enhance the encapsulation effect. The first curved groove 300 may have a symmetric center line, which may be a curved line. The symmetric center line may be parallel to the curved edge of the irregular-shape display area 120. In an embodiment, the organic units 410 are made of organic glue. The organic unit 410 may be formed on an upper surface of the anode layer 200 by deposition. The organic units 410 may be used to cover the opening provided on the anode layer 200, and cover borders of the anode, so as to prevent migration of Ag in the anode.

During the formation of the organic unit array 400, the organic units 410 may fall on the surface of the first curved groove 300, thereby affecting the subsequent encapsulation effect. Therefore, to ensure the encapsulation effect, it is needed to remove the organic unit 410 falling into the first curved groove 300. Consequently, the organic unit array 400 may be damaged. When an irregular arrangement presents in the organic unit array 400, the bonding between the cathode layer 230 formed on the organic unit array 400 and the anode layer 200 will be uneven, thereby resulting in nonuniformity of luminance of the screen. Specially, within the regions where some organic units 410 are removed, a larger area of the anode will be formed. Since moisture in the organic glue cannot be released, problems such as bubbles in the anode or pores in the organic glue can occur. Therefore, it is important to arrange the organic unit array 400 evenly and regularly.

According to the driving substrate provided by the present disclosure, since the first curved groove 300 is located between any two organic units 410 of the organic unit array 400, the first curved groove 300 is not in contact with the organic units 410, to avoid the organic units 410 from falling into the first curved groove 300. On the basis that the organic units 410 do not fall into the first curved groove 300, the distances between every two adjacent organic units 410 in each unit row 420 or in each unit column 430 are identical. Therefore, the plurality of organic units 410 are disposed evenly in the organic unit array 400. The gaps between every two adjacent organic units 410 are the same in size. Since the cathode layer 230 is formed on the surface of the organic unit array 400 away from the substrate 100, and is bonded to the anode layer 200 via the gap between any two organic units 410. The bonding areas of the cathode layer 230 and the anode layer 200 between every two organic units 410 are identical. Therefore, the problem of uneven bonding between the anode layer and the cathode layer caused by the removal of a portion of the organic units is avoided, such that the display brightness of the screen is more uniform.

In an embodiment of the present disclosure, the distances between every two adjacent organic units 410 in each unit row 420 or in each unit column 430 are identical. The first curved groove 300 passes via the organic unit array 400 between any two adjacent organic units 410. Therefore, the first curved groove 300 is not in contact with the organic units 410, to avoid the organic units 410 from falling into the first curved groove 300. Therefore, the problem of uneven bonding between the anode layer 200 and the cathode layer 230 caused by the removal of a portion of the organic units 410 is avoided, such that the display brightness of the screen is more uniform.

In an embodiment, the organic unit 410 is in a central symmetric structure. The organic unit 410 may be of a shape of a circle, a square, a regular polygon or the like. The organic unit 410 in the central symmetric structure may be rotated along with the extension of the first curved groove 300, to avoid the first curved groove 300 and not to change the evenness of the organic unit array 400.

In an embodiment, the organic unit 410 is of a square structure. The opening formed on the anode layer 200 may be configured to increase the bonding effect of the anode layer 200 with other layers. The opening formed on the anode layer 200 may be of a shape of a square. The organic unit 410 of a square structure can match the opening, to save materials.

In an embodiment, the square structure has a side length of 15 μm to 20 μm. The square structure having the side length of 15 μm to 20 μm can cover the opening formed on the anode layer 200 completely, which can further save materials.

In an embodiment, the first curved groove 300 has a width of 3 μm to 7 μm. The distance between every two adjacent organic units 410 is 10 μm to 22 μm. The first curved groove 300 having a width of 3 μm to 7 μm can enhance the sealing effect. The distance between any two adjacent organic units 410 being 10 μm to 22 μm can result in a larger distance margin between any two adjacent organic units 410, facilitating the first curved groove 300 to pass via the organic unit array 400. Furthermore, the bonding between the anode layer 200 and the cathode layer 230 has a better effect.

In an embodiment, the distance from the symmetric center line of the first curved groove 300 to any one of the organic units 410 is greater than 2 μm. The first curved groove 300 is symmetric with respect to the symmetric center line. The distance from the symmetric center line to any one of the organic units 410 being greater than 2 μm can completely avoid the influence of the surrounding organic units 410 on encapsulating during a subsequent encapsulation process.

Figure 3:
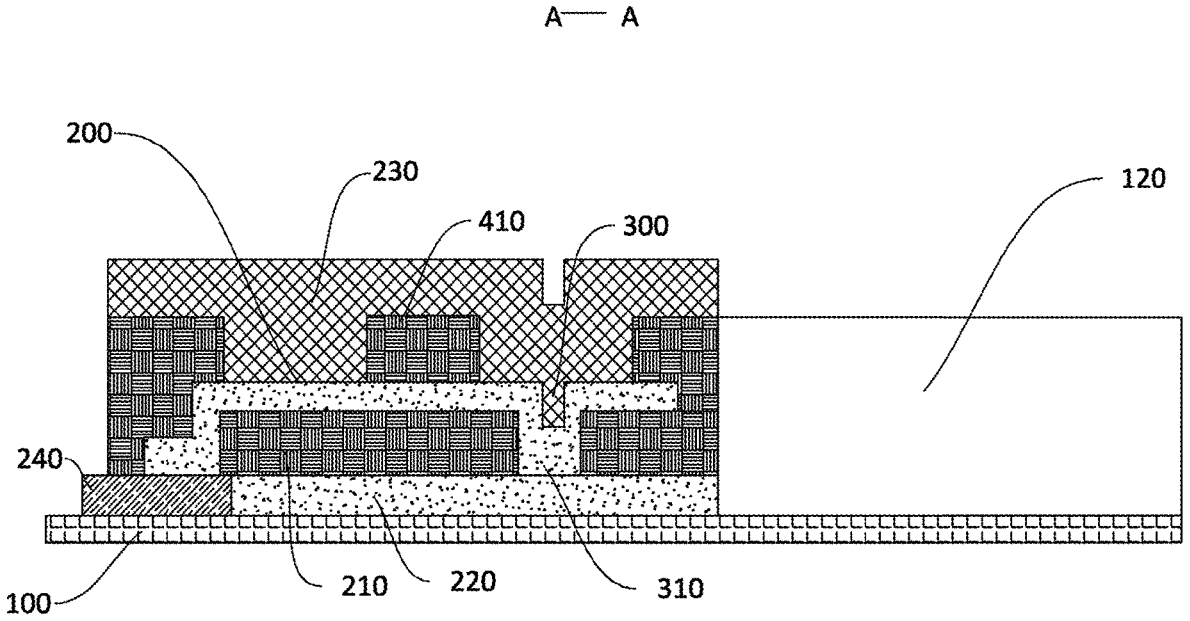
FIG. 3 is a sectional view of a driving substrate provided by an embodiment of the present disclosure.

Referring to FIG. 3, in an embodiment, the substrate 100 and the anode layer 200 have a circuit protection layer 210 disposed therebetween. The circuit protection layer 210 is provided with a second curved groove 310 corresponding to the first curved groove 300. The circuit protection layer 210 may be made of an organic material. The circuit protection layer 210 can be provided with the second curved groove 310. When the anode layer 200 is formed on a surface of the circuit protection layer 210 away from the substrate 100, a portion of the anode layer 200 deposited in the second curved groove 310 fills the second curved groove 310. Since a thickness of the anode layer 200 formed on the surface of the circuit protection layer 210 is the same, the first curved groove 300 is further formed on the anode layer 200. After the second curved groove 310 is formed, the first curved groove 300 may be formed by a general process without adding any other processes, which can improve the production efficiency.

In an embodiment, the substrate 100 and the circuit protection organic layer have a pixel drive circuit layer 220 disposed therebetween. The pixel drive circuit layer 220 may include a gate drive circuit.

In an embodiment, a cathode layer 230 is formed on the surface of the organic unit array 400 away from the substrate 100. The cathode layer 230 is bonded to the anode layer 200 via the organic unit array 400. After the cathode layer 230 is bonded to the anode layer 200, a power circuit layer 240 may be powered up.

An embodiment of the present disclosure further provides a display panel. The display panel includes the driving substrate 10. The driving substrate 10 further includes an irregular-shape display area 120. The irregular-shape non-display area 110 surrounds the irregular-shape display area 120. The edge of the irregular-shape display area 120 has a shape same to that of the first curved groove 300. The driving substrate 10 may further include a normal display area 130. Since the first curved groove 300 passes via the organic unit array 400 between any two adjacent organic units 410, the first curved groove 300 is not in contact with the organic units 410, to avoid the organic units 410 from falling into the first curved groove 300. Therefore, the problem of uneven bonding between the anode layer 200 and the cathode layer 230 caused by the removal of a portion of the organic units 410 is avoided, to improve the problem of nonuniformity of the display brightness of the screen effectively, and to cause the luminance of the display panel to be more uniform.

All of the technical features in the embodiments can be employed in arbitrary combinations. For purpose of simplifying the description, not all arbitrary combinations of the technical features in the embodiments illustrated above are described. However, as long as such combinations of the technical features are not contradictory, they should be considered as within the scope of the disclosure in the specification.

The above embodiments are merely illustrative of several implementations of the disclosure, and the description thereof is more specific and detailed, but should not be deemed as limitations to the scope of the present disclosure. It should be noted that variations and improvements will become apparent to those skilled in the art to which the present disclosure pertains without departing from its scope. Therefore, the scope of the present disclosure is defined by the appended claims.

The invention claimed is:

1. A driving substrate, comprising:

a substrate comprising an irregular-shaped non-display area;

an anode layer located on the irregular-shaped non-display area and comprising a upper surface and a lower surface, wherein the anode layer comprises a first curved groove for encapsulating extending a distance from the upper surface toward the lower surface; and an organic unit array comprising a plurality of organic units and disposed on the upper surface of the anode layer, the plurality of organic units forming a plurality of unit rows and a plurality of unit columns, distances between every two adjacent organic units in each unit row being substantially identical, distances between every two adjacent organic units in each column row being substantially identical, and the first curved groove being located between two organic units of the organic unit array.

2. The driving substrate of claim 1, wherein a symmetric center line of the first curved groove is a curved line, and is parallel to an edge of the irregular-shaped non-display area.

3. The driving substrate of claim 1, wherein the anode layer is provided with an opening, and the organic unit is formed on an upper surface of the anode layer by deposition, and covers the opening on the anode layer.

4. The driving substrate of claim 1, wherein the organic unit is in a central symmetric structure.

5. The driving substrate of claim 4, wherein the organic unit is of a square structure.

6. The driving substrate of claim 5, wherein the square structure has a side length of 15 μm to 20 μm.

7. The driving substrate of claim 1, wherein the first curved groove has a width of 3 μm to 7 μm, and the distance between two adjacent organic units is 10 μm to 22 μm.

8. The driving substrate of claim 1, wherein the first curved groove has a symmetric center line, and a distance from the symmetric center line to any one of the organic units is greater than 2 μm.

9. The driving substrate of claim 1, wherein the substrate and the anode layer have a circuit protection layer disposed therebetween, and the circuit protection layer is provided with a second curved groove corresponding to the first curved groove.

10. The driving substrate of claim 9, wherein a portion of the anode layer deposited in the second curved groove fills the second curved groove when forming the anode layer.

11. The driving substrate of claim 9, wherein the circuit protection layer is made of an organic material.

12. The driving substrate of claim 9, wherein the substrate and the circuit protection layer have a pixel drive circuit layer disposed therebetween.

13. The driving substrate of claim 1, wherein a cathode layer is formed on a surface of the organic unit array away from the substrate, and the cathode layer is bonded to the anode layer via a plurality of gaps defined between organic units of the plurality of organic units of the organic unit array.

14. The driving substrate of claim 13, wherein bonding areas of the cathode layer and the anode layer between every two adjacent organic units of the plurality of organic units are identical.

15. A display panel, comprising the driving substrate of claim 1, and an irregular-shaped display area surrounded by the irregular-shaped non-display area.

16. The display panel of claim 15, wherein an edge of the irregular-shaped display area has a shape same as that of the first curved groove.

17. The display panel of claim 15, wherein the display panel is provided with a notch, and a portion of the non-display area surrounding the notch forms the irregular-shaped non-display area.

* * * * *